United States Patent [19]

Fujimori et al.

[11] 4,279,651

[45] Jul. 21, 1981

[54] SINTERED HARD METAL AND THE METHOD FOR PRODUCING THE SAME

[75] Inventors: Naoji Fujimori; Masaaki Tobioka; Tsuyoshi Asai; Takaharu Yamamoto; Masaya Miyake, all of Itami, Japan

[73] Assignee: Sumitomo Electric Industries, Ltd., Japan

[21] Appl. No.: 974,512

[22] Filed: Dec. 28, 1978

[30] Foreign Application Priority Data

Dec. 29, 1977 [JP] Japan ..... 52-159299

[51] Int. Cl.[3] ..... C22C 29/00

[52] U.S. Cl. ..... 75/233; 75/237; 75/238; 75/203; 75/204; 75/205; 75/206

[58] Field of Search ..... 75/203, 204, 238, 233, 75/237, 206, 205

[56] References Cited

U.S. PATENT DOCUMENTS 3,703,368 11/1972 Rudy ..... 75/175.5
3,708,355 1/1973 Rudy ..... 148/32
4,049,876 9/1977 Yamamoto et al. ..... 75/238

OTHER PUBLICATIONS

Rudy "Journal of Less Common Metals" vol. 33, #1, 1973, pp. 43–70.

*Primary Examiner*—Brooks H. Hunt
*Attorney, Agent, or Firm*—Wenderoth, Lind & Ponack

[57] ABSTRACT

The invention relates to a sintered hard metal having a high wear resistance and heat resistance as material for cutting tools and wear resistant tools and the method for producing the same. The sintered hard metal has a hard phase comprising a phase having a B-1 type crystal structure containing more than one kind of IVa, Va and VIa group metals in the Periodic Table and also the elements, carbon, nitrogen and oxygen and a WC phase, the hard phase and a bonding phase chiefly consisting of a ferrous metal which is sintered by a powder metallurgy technique, whereas the oxygen in particular is added thereto making it possible to obtain a sintered hard metal having said excellent properties.

9 Claims, 1 Drawing Figure

FIGURE
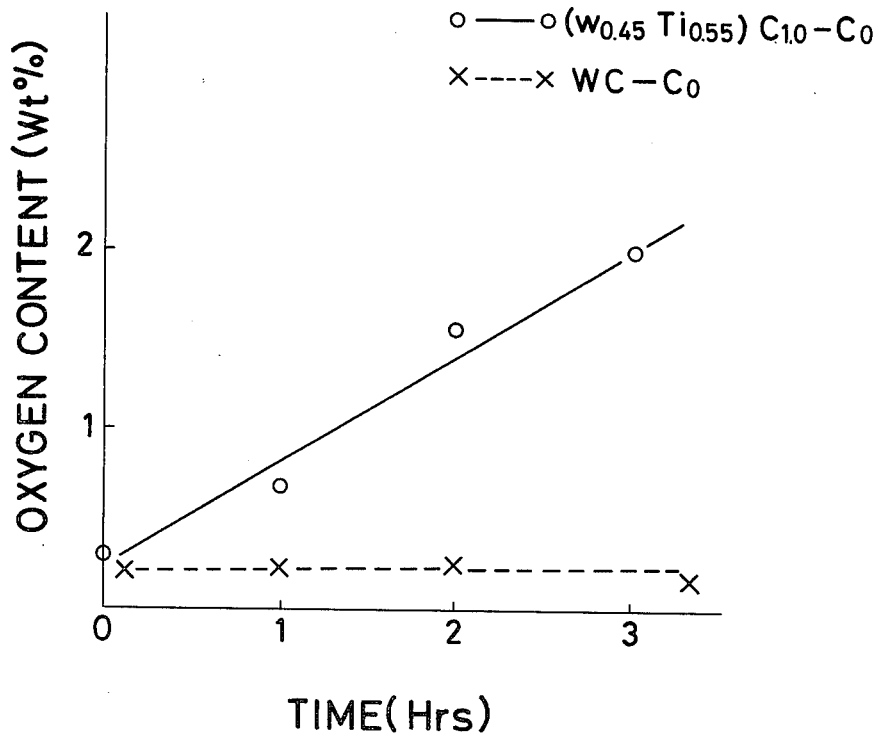

SINTERED HARD METAL AND THE METHOD FOR PRODUCING THE SAME

BACKGROUND OF THE INVENTION

The sintered hard metals extensively for use in cutting tools and wear resistant tools are divided broadly into two categories: WC bonded by Co and two different kinds of hard phases bonded by Co. To be sure precise, the latter is a combination by Co of a WC phase and a compound carbide phase constituted by more than one kind of the IVa, Va and VIa group elements, and particularly more than 2 kinds of metals selected from Ti, Ta, Nb and W. The mixed carbide phase has B-1 type crystals, one of an ordinary face-centered cubic structure, and is represented by the general formula of $(M_A,M'_B,M''_C)(C_u,N_v,O_w)_z$. Generally, the hard phase having B-1 type crystals (hereinafter referred to as a B-1 type hard phase) has a higher hardness compared with WC and a less chemical reaction with steel. For steel cutting purposes, therefore, is used a sintered hard metal in which a B-1 type hard phase coexists with a WC phase.

The B-1 type hard phase has been called a mixed carbide since it contains only C as a nonmetallic, element, and the production method thereof has heretofore been contemplated on the principle of excluding N and O as impurities. In recent years, however, studies have been made on the effect of addition of N, and active utilization thereof is now in progress. In fact, some of the inventors of the present application have made a proposition in relation to this problem (Laid-Open Gazette No. SHO-51-46508). However, the addition of O has been considered to be improper since firstly CO gas is produced by the reaction thereof to the carbide in the course of sintering thereby permitting porosity to remain in the sintered body, and secondly the control of the total amount of C, N and O is attended by difficulties.

SUMMARY OF THE INVENTION

The invention relates to a sintered hard metal extensively for use in cutting tools and wear resistant tools, and has for an object to improve the wear resistance and heat resistance of the hard phase constituted by a compound carbide phase having B-1 type crystals generally represented by $(M_A,M'_B,M''_C)(C_u,N_v,O_w)_z$ and a WC phase by causing said hard phase to contain oxygen.

A further object of the invention consists in the construction of a sintered hard metal obtainable by the use of said hard phase having a high wear resistance and heat resistance, and the production method thereof.

BRIEF DESCRIPTION OF THE DRAWING

The drawing shows the variation of the oxygen content in a compact of WC-Co(10 weight %) and $(W_{0.45}Ti_{0.55})C_{1.0}$-Co(12.8 weight %) when heated in a carbon monoxide atmosphere at a pressure of 100 Torr for 0~3 hours.

DETAILED DESCRIPTION OF THE INVENTION

The invention relates to a sintered hard metal for use in cutting tools and wear resistant tools and the method for producing the same.

The so-called sintered hard metals extensively for use in cutting tools and wear resistant tools are divided broadly into two categories: WC bonded by Co, and two different kinds of hard phases bonded by Co, to be more precise, a mixed carbide phase composed of more than one kind of IVa, Va and VIa group elements, particularly more than two kinds of metals selected from Ti, Ta, Nb and W, bonded by Co. The invention relates to a sintered hard metal belonging to the latter category. Generally, the mixed carbide phase has B-1 type crystals, one of the facecentered cubic structure, and is represented by the following general formula.

$$(M_A,M'_B,M''_C)(C_u,N_v,O_w)_z \quad (1)$$

wherein

M: represents Group IVa metals

M': represents Group Va metals

M'': represents Group VIa metals

A, B, C, u. v, w represents the atomic ratios respectively. z represents the ratio of nonmetallic elements to metallic elements. The relation thereof is as follows:

$$A+B+C=1,$$

$$u+v+w=1$$

Generally, the hard phase having B-1 type crystals (hereinafter referred to as a B-1 type hard phase) has a higher hardness and less of a chemical reaction to steel as compared with WC. For this reason, a sintered hard metal in which a B-1 type hard phase coexists with a WC phase is used for steel cutting tools.

The following are regarded as factors to determine the properties of the sintered hard metal:

1. comparison between B-1 type hard phase and WC
2. structure of B-1 type hard phase
3. property of Co phase
4. Existence of heterogeneous phases (free carbon, porosity)

Heretofore, trials for improvement have been mainly done on factors 1, 3 and 4, while no noticeable improvements have been practially made in connection with factor 2 for the following reasons. Since the metallic elements chiefly constituting the B-1 type hard phase are Ti, Ta, Nb and W, it has been considered that it is difficult to greatly improve the properties by adding any other element. Moreover, it is unconceivable that there is any other element that is industrially cheaper than Ti. Furthermore, the nonmetallic elements have been greatly limited according to the conventional conception.

Heretofore, the B-1 type hard phase was known as a mixed carbide since it contained only C as a nonmetallic element, and the method for producing was contemplated on the principle of excluding N and O as impurities. In recent years, however, experiments have been made on the effect of addition of N, and a positive use thereof is now in progress. A patent application in connection with this problem has already been filed by some of the present inventors (Laid-Open Gazette No. SHO-51-46508).

As far as the addition of O is concerned, however, it has been a matter of common sense that the proposition is improper. The reasons: firstly, CO gas is produced by the reaction of oxygen to the carbide in the course of sintering thereby permitting porosity to remain in the sintered body, and secondly the control of the total amount of C, N and O is attained by difficulties.

The production of CO gas is not exclusively attributable to the dissolution reaction of the B-1 type hard phase but also to the dispersion reaction of O and C through the Co phase, and this is the essential difference between the case of addition of N and that of O. The inventors of the present application have carefully researched this problem and developed a method for producing a sintered hard metal containing oxygen. The oxygen-containing sintered hard metal thus obtained has the anticipated high properties, which will be described in detail hereinunder.

Firstly, the property of the B-1 type hard phase is changed as a result of the change of the composition thereof. In Laid-Open Gazette No. SHO-51-46508, some of the inventors of the present application disclosed that the stability of the B-1 type hard phase was dependent on VEC (Valence Electoron Concentration). Further research on this problem has resulted in the following findings. As is well known, VEC is represented by the following formula.

$$VEC=4A+5B+6C+Z(4u+6v+6w)$$

In the sintered hard metal having a WC phase, the stability of the B-1 type hard phase has a limit at VEC=8.60, unstability arising thereabove. In case of a general sintered hard metal having only W as a VIa group element, for example, the B-1 type hard phase when unstabilized deposited WC due to the following reaction.

$$(M_{A1}, M'_{A2}, M''_{B1} \ldots\ldots W_{C1})(C_u, N_v, O_w) \xrightarrow[z]{}$$

$$(M_{A1}', M'_{A2}' M''_{B1}' \ldots W_{C1}')(C_u', N_v', O_w') + (C_1 - C_1')WC$$

(wherein $C_1 > C_1' > O$)

In this case, pentavalent nitrogen and sexivalent oxygen have a large effect of increasing VEC thereby enabling to increase the eduction of WC. Thus, the addition of oxygen enables the B-1 type hard phase to coexist with WC in the state of a small amount of W. As a result, the heat resistance of the B-1 type hard phase is increased whereby the heat resistance of the entire sintered hard metal can be improved.

It is well known that, even when Mo and the like of VIb group elements are mixed in addition to W, an MC type carbide having a crystal structure of the hexagonal system same as WC is produced (Laid-Open Gazette No. SHO-51-146306). Thus, the same reaction as the afore-mentioned formula is obtainable. If there exists no W at all, however, MC type carbide of the hexagonal system is hardly formed. Therefore, it is necessary that the carbide phase contains W.

Secondly, if the sintered hard metal is used as a sliding member of the cutting tool which is the representative use thereof, the following effect is obtainable: When steel is cut by sintered hard metal, for example, glassy compound oxides of Ti, Al, Si, Ca, etc. are formed on the surface of the edge. It is conceivable that the glassy compound oxides serve as lubricants thereby greatly helping to increase the wear resistance of the sintered hard metal. If the B-1 type hard phase initially contains oxygen, the glassy substance is produced with greater ease thereby enabling to provide more preferable cutting tools. The same conception is applicable to the sliding member.

When a sintered hard metal having the afore-said advantages is used for a cutting tool, the following effect is produced. Firstly, the improved heat resistance enables the edge to resist higher temperature, whereby the cutting tool is capable of cutting at higher speed. Moreover, a far better cut face is obtainable since the wear resistance is increased. This is apparently due to the aforementioned second effect.

As described hereinbefore, the sintered hard metal according to the invention displays high properties as a cutting tool. Moreover, it is needless to mention that the sintered hard metal, when used as a substrate coated with a thin film of a hard material, is capable of producing a higher effect compared with a conventionally coated substrate. In case of use as a substrate, its toughness will be further increased if the substrate is adapted to contain a suitable amount of free carbon.

The scope of the limitation of the invention will be described hereinunder.

According to the research findings by the inventors of the present application, existence of too great an amount of O and N among the nonmetallic elements is liable to deteriorate the sintering property. Therefore, the relationship $u+v<0.5$ is a prerequisite.

With reference to the oxygen content, no effect is produced when v is less than 0.005, while the sintering property is unpreferably deteriorated when it is greater than 0.5. Thus, the range from 0.005 to 0.5 is suitable, and the range between 0.01 and 0.1 is most preferable for a cutting tool.

It is a matter of course that no B-1 type solid solution is produced if $A=B=0$. Though $A+B>0$ is prerequisite, $A+B>0.5$ is preferable when a high heat resistance is required.

The conventional vacuum sintering method was not capable of producing an oxygen-containing sintered metal for the reason that the B-1 type hard phase was unstable in the vacuum.

Careful research by the inventors of the present application has disclosed that the B-1 type hard phase is stable even when it contains oxygen if carbon monoxide atmosphere is partially employed during the rise of the temperature.

A proposition of effecting the sintering in carbon monoxide atmosphere, though not intended for oxygen content, has been made in U.S. Pat. No. 3,999,953. According to the findings of the inventors of the present application, however, the proposed sintering method is imperfect, vacuum atmosphere being necessitated at the final sintering temperature, strictly speaking. The reason is that, in the state in which the open pores have substantially disappeared, a sufficient degassing treatment is necessitated in order to completely remove the porosity.

Vacuum is necessitated above the temperature at which a liquid phase capable of erasing the open pores disappears. In case the temperature is raised above said level, it is preferable that the B-1 type hard phase is placed under carbon monoxide partial pressure for the stability of the construction thereof. However, vacuum atmosphere is necessitated until the temperature reaches the maximum sintering level. Though the higher the lower pressure is the more complete is the degassing, a pressure below about $10^{-1}$ Torr will be sufficient.

It must be noted, however, that the carbon monoxide atmosphere, if below 600° C., increases the amount of carbon by a dissolution reaction as shown hereinunder.

$$2CO \rightarrow CO_2 + C \qquad (2)$$

Since the total amount of the nonmetallic elements of the entire sintered hard metal is unpreferably rendered uncontrollable, the carbon monoxide atmosphere should be employed at a temperature higher than 600° C.

It is not necessary that the B-1 type hard phase contain oxygen therein, according to the present invention.

In FIG. 1 is shown the variation of the oxygen content when a compact of WC-Co(10 weight %) and that of a $(W_{0.45}Ti_{0.55})C_{1.0}$-Co(12.8 weight %) are heated in an atmosphere of carbon monoxide at a partial pressure 100 Torr for 0~3 hours. As the FIGURE shows, though no oxygen is contained in case of a simple WC-Co compact, oxygen infiltrates from the CO atmosphere into the compact having a B-1 type hard phase. This shows that oxygen can be added to a B-1 type hard phase which originally contained no oxygen. Such shift of oxygen is conceivably made possible by the fact that the carbon monoxide atmosphere has a high oxygen potential.

The sintered hard metal obtained by imparting oxygen thereto in the course of the heating step also displays high properties as an oxygen-containing sintered hard metal.

The present inventors thought that it is preferable for economical reasons of the production cost to add oxygen in the course of the heating step for small amounts of oxygen to be contained. The invention will be described in more detail with reference to the following examples.

EXAMPLE 1

65 weight % of WC having a mean particle size of 1μ, 37 weight % of $(Ti_{50},W_{50})C$ having a mean particle size of 2μ and 8 weight % of Co having a mean particle size of 1μ were mixed by a wet ball mill to prepare a raw powder for a sintered hard metal comprising WC-12 TiC-8Co. The powder was pressed (type SNG 432) under a pressure of 1.5 t/cm² and sintered by the following two methods.

| | | | |
|---|---|---|---|
| (A) | Method of this Invention | | |
| | Normal temperature ~ 1000° C. ~ 1400° C. | Vacuum | Below $5 \times 10^{-1}$ Torr |
| | | CO | 200 Torr |
| | 1400° C. × 1 hr | Vacuum | Below $1 \times 10^{-1}$ Torr |
| (B) | Conventional Method | | |
| Vacuum sintering | Normal temperature ~ 800° C. | | Below $5 \times 10^{-1}$ Torr |
| | 800° C. ~1400° C. | | Below $1 \times 10^{-1}$ Torr |

The compositions of the B-1 type hard phases of the sintered hard metals thus obtained were as follows.

(A) $Ti_{0.58}W_{0.42})(C_{0.93}O_{0.07})0.95$ (B) $(Ti_{0.50}W_{0.50})(C_{0.998}O_{0.002})_{0.93}$

Prior to the chemical analysis of the B-1 type hard phase, Co and WC phase were dissolved by a potentiostat, and dehydration after careful washing was effected in a vacuum below $10^{-4}$ Torr at 150° C. for more than 24 hours. Such care is essential since the chemical analysis of oxygen is greatly affected by the presence of adsorbed moisture and oxygen.

The product obtained by the method (A) was satisfactory and free from porosity. By way of comparison, the product according to the invention and the conventional product were subjected to cutting tests under the following conditions.

| | Test 1 | Test 2 |
|---|---|---|
| Work | SK 5 | SCM 3 |
| Cuting speed (m/min) | 120 | 100 |
| Feed (mm/rev) | 0.8 | 0.36 |
| Cutting depth (mm) | 1.5 | 1.5 |
| Cutting time (min) | 3 | 40 |

The results were as follows.

TABLE 1

| | Test 1 | Test 2 |
|---|---|---|
| | Edge plastic deformation amount | Flank wear |
| Product of this Invention | 0.15 mm | 0.12 mm |
| Conventional Product | 0.31 | 0.20 |

As is clear from the above-mentioned results, the product according to the invention is a sintered hard metal having a very high heat resistance.

EXAMPLE 2

B-1 type solid solution of $(W_{0.5}Ti_{0.5})(C_{0.7}O_{0.3})_{1.0}$ was prepared from WC having a mean particle size of 1μ, TiC having a mean particle size of 1μ and TiO having a mean particle size of 1.5μ. Raw powder for sintered hard metals as shown in Table 2 were prepared.

TABLE 2

| | WC | (W,Ti)(C, O) | Co |
|---|---|---|---|
| (A) | | 90 wt % | 10 wt % |
| (B) | 30 wt % | 60 | 10 |
| (C) | 60 | 30 | 10 |
| (D) | 90 | | 10 |

The sample powders were sintered by the sintering method according to the invention and the conventional vacuum sintering method, respectively. The former method was same as in Example 1 except that the pressure of the carbon monoxide atmosphere was the 760 Torr. Then the oxygen contents were examined.

In case of the vacuum sintering method, η phase and porosity were formed in the sample powders (A), (B) and (C). It is presumable that decarbonization arose as a result of a reaction between C and O.

Highly satisfactory results were obtained from the sintering method according to the invention.

EXAMPLE 3

Commercial WC having a mean particle size of 1μ, $TiO_2$ having a mean particle size of 0.2μ and TiC having a mean particle size of 1μ were used as material to obtain $(W_{0.40},Ti_{0.50},Ta_{0.10})(C_{0.9},N_{0.03},O_{0.07})_{1.0}$. The B-1 type hard phase thus obtained was wet-mixed with WC having a mean particle size of 3μ and Co having a mean particle size of 1μ, 2 weight % of paraffin being added to the mixture after drying, the mixture being pressed under a pressure of 1.5 t/cm² and sintered at 1400° C. for 1 hour. The sintered hard metal thus obtained showed the following atomic ratio.

$$(\text{B-1 type hard phase})_{0.35}(\text{WC phase})_{0.55}(\text{Co phase})_{0.1}$$

The composition of the B-1 type hard phase was as follows.

$(W_{0.35},Ti_{0.52},Ta_{0.13})(C_{0.89},N_{0.03},O_{0.08})_{0.95}$

The sintered hard metal thus obtained was compared with a commercial sintered hard metal containing no oxygen (each phase having the same atomic ratio as that of the product of the invention) in respect of flank wear under the following conditions.

| | |
|---|---|
| Work | S 50 C ($H_B$ = 280) |
| Cuting speed | 110 m/min |
| Cutting depth | 2 mm |
| Feed | 0.36 mm/rev |
| Cutting time | 30 min |
| Shape of insert | SNG 432 |

As a result, the flank wear of the insert of the invention was 0.18 mm, while that of the commercial insert was 0.25 mm, that is, the product of the invention had a higher wear resistance.

EXAMPLE 4

Commercial WC having a mean particle size of 2μ and Co having a mean particle size of 1μ were mixed with different hard phase powders respectively to obtain sintered hard metals by the same process as in Example 1. The products thus obtained were compared in respect to the properties. The Co phases were unified at an atomic ratio of 0.1.

TABLE 3

| Structure of B-1 Hard Phase in Sintered Metal | Flank Wear |
|---|---|
| $(W_{0.38}Ti_{0.62})(C_{0.95}N_{0.001}O_{0.049})_{0.95}$ | 0.24 mm |
| $(W_{0.35}Ti_{0.65})(C_{0.95}N_{0.01}O_{0.04})_{0.95}$ | 0.24 |
| $(W_{0.30}Ti_{0.70})(C_{0.9}N_{0.05}O_{0.05})_{0.96}$ | 0.16 |
| $(W_{0.25}Ti_{0.75})(C_{0.8}N_{0.05}O_{0.15})_{0.98}$ | 0.13 |
| $(W_{0.2}Ti_{0.8})(C_{0.6}N_{0.05}O_{0.35})_{0.96}$ | 0.14 |
| $(W_{0.2}Ti_{0.8})(C_{0.6}N_{0.2}O_{0.2})_{0.95}$ | 0.13 |
| $(W_{0.32}Ti_{0.40}Ta_{0.28})(C_{0.9}N_{0.05}O_{0.05})_{0.96}$ | 0.18 |
| $(W_{0.33}Ti_{0.39}Zr_{0.28})(C_{0.9}N_{0.05}O_{0.05})_{0.95}$ | 0.16 |
| $(W_{0.35}Ti_{0.39}Nb_{0.26})(C_{0.9}N_{0.05}O_{0.05})_{0.95}$ | 0.17 |
| $(W_{0.40}Ti_{0.38}Hf_{0.22})(C_{0.9}N_{0.05}O_{0.05})_{0.95}$ | 0.17 |
| Comparative Products | |
| $(W_{0.5}Ti_{0.5})C_{0.93}$ | 0.25 |
| $(W_{0.35}Ti_{0.4}Ta_{0.25})C_{0.93}$ | 0.26 |
| ISO P20 | 0.29 |

EXAMPLE 5

85.5 weight % of WC, 40 weight % of $(Ti_{0.5}W_{0.5})C$, 5.0 weight % of NbC and 5 weight % of Co were mixed to prepare a compact by the same process as in Example 1. (Type TNMG 432 ENZ) The compact sintered under $10^{-3}$ Torr and in a vacuum up to 1450° C. was named (A), whilst the compact sintered under $10^{-3}$ Torr up to 600° C., in CO atmosphere up to 600°~1450° C. under $P_{co}$=300 Torr, and then under $10^{-3}$ Torr at 1450° C. for 1 hour, was named (B). (A) and (B) were coated with TiC 6μ by the known chemical vapor deposition method.

(A) and (B) were subjected to cutting tests under the following conditions.

| | |
|---|---|
| Work | S 55 C forged material 50 mmϕ × 2300 mm |
| Cutting speed 150 m/min | |
| Feed | 0.50 mm/rev |
| Cutting depth | 1 ~ 5 mm |

No lubricant was used.

The insert (B) according to the invention was capable of processing 48 pieces, while the insert (A) was capable of processing only 31 pieces.

EXAMPLE 6

Sintered hard metal inserts in Table 4 were prepared by the methods as described in Example 5. The sintering temperature was 1425° C., and the sintered hard metal was coated with TiC 4μ by the ordinary chemical vapor deposition method with its upper layer further coated with TiN 2μ.

The inserts thus obtained were subjected to turning tests by using are longitudinally slotted work SCM 3 ($H_B$280) by way of comparison under the following conditions.

| | |
|---|---|
| Cutting speed | 80 m/min |
| Cuting depth | 2 mm |
| Feed | 0.25 mm/rev |

TABLE 4

| | | Raw Material | | Sintering Condition |
|---|---|---|---|---|
| Product of this invention | A | WC | :83.5 wt % | $P_{co}$ = 200 Torr at 1000 ~ 1400° C. |
| | | $(W_{0.45}Ti_{0.45}Ta_{0.1})C_{1.0}$ | :10.5 | Vacuum below $10^{-1}$ Torr |
| | | Co | :6.0 | except the above |
| | B | WC | :83.4 | $P_{co}$ = 150 Torr at 1000 ~ 1400° C. |
| | | $(W_{0.45}Ti_{0.45}Ta_{0.1})(C_{0.9}O_{0.1})_{1.0}$ | :10.6 | Vacuum below $10^{-1}$ Torr |
| | | Co | :6.0 | except the above |
| Comparative Product | C | Same as A | | Vacuum below $10^{-1}$ Torr |
| | D | Same as A | | $P_{co}$ = 200 Torr below 1000° C. |

As a result of the cutting tests, C was damaged in 3 minutes and D in 4 minutes, while A and B, the inserts according to the invention, were intact even after 15 minutes.

Furthermore, A, the product according to the invention, displayed the same satisfactory properties even when a carbide in which W was partially replaced by Mo was used in place of WC.

As described hereinbefore, the sintered hard metal according to the invention produced a highly satisfactory effect as substrate.

EXAMPLE 7

By use of commercial TiC, TiO, WC, $(Ti_{0.50}W_{0.50})(C_{0.90}O_{0.10})_{1.0}$ was prepared. 16.5 weight % of the B-1 type hard phase thus obtained was mixed with 72.0 weight % of WC having a mean particle size of 3μ and 11.5 weight % of Co having a mean particle size of 1μ by a wet ball mill, and 2 weight % of paraffin was added thereto after the drying process. The mixture was pressed under a pressure of 1.5 ton/cm$^2$ and vacuum sintered at 1380° C. for 5 hours. A microscopic examination of the sintered hard metal thus obtained disclosed that the B-1 type hard phase had disappeared down to 150μ from the surface.

By way of comparison, a sintered hard metal of the aforesaid mixing ratio was prepared from commercial $(Ti_{0.50}W_{0.50})C$. However, no similar area of disappearance of the B-1 type hard phase was found on the surface of the metal though sintered by the same method.

The product obtained from $(Ti_{0.50}W_{0.50})(C_{0.90}O_{0.10})_{1.0}$ as material was named (A), while the product obtained from $(Ti_{0.50}W_{0.50})C$ as material was named (B), and guide rollers for steel wire drawing were produced by use of the two sintered hard metals, respectively. The temperature of the wire material was about 1050° C. and the drawing speed was 30 m/sec. The life of the conventional product reached its limit due to heat cracks after passage of 50 t, while heat cracks were very slight in case of the product according to the invention even after passage of 700 t.

It is well known that a sintered hard metal containing a B-1 type solid solution has a poor resistance to heat cracks. In case of A, the product according to the invention, it has no B-1 type hard phase on the surface brought into contact with the wire material and a WC-Co layer having a high resistance to heat cracks is formed on said surface. Hence the result of this example.

Furthermore, the specific gravity of the B-1 type hard phase is smaller than that of WC. Thus, the product according to the invention has an advantage in that it is lighter in weight compared with the product of WC-Co sintered hard metal only, thereby enabling to reduce the load of the bearings.

What is claimed is:

1. A sintered hard metal having a B-1 type crystal structure composed of a hard phase and a WC phase as well as a bonding phase chiefly composed of ferrous metals, characterized in that said hard phase consists essentially of at least two different kinds of metals selected from Group IVb, Vb and VIb metals of the Periodic Table in combination with carbon, nitrogen and oxygen which hard phase is represented by the molecular formula $(M_A, M'_B M''_C)(C_uN_vO_w)_z$ wherein M represents Group IVa metals, M' represents Group Va metals and M'' represents Group VIa metals, A, B, C and u, v, w represent the atomic ratio of the elements in the formula, and z represents the ratio of the total number of the metallic atoms to that of C,N,O atoms, with the relationship such that $A+B+C=1$, $u+v+w=1$, $A \geqq O$, $B \geqq O$, $A+B>O$, $C>O$, $u>O$, $z \geqq 0.6$, and $0.005<v+w \leqq 0.5$ and $0.005<W<0.5$.

2. A sintered hard metal as defined in claim 1, further characterized in that a substrate consisting of said sintered hard metal is coated with 1 or more than 2 layers comprising 1 or more than 2 kinds of a carbide, nitride, oxide, boride and/or a compound thereof of the IVa, Va and VIIa group elements, $Al_2O_3$ and AlN, of a thickness of 1 to 20 in., respectively.

3. A sintered hard metal as defined in claim 1, further characterized in that a part of W in the WC phase is replaced by another element which does not change the crystal structure of the hexagonal system.

4. A sintered hard metal according to claim 1 in which the hard phase contains at least two metals selected from the group consisting of Ti, Ta, Nb and W.

5. A method for producing a sintered hard metal having a B-1 type crystal structure composed of a hard phase and a WC phase as well as a bonding phase chiefly composed of ferrous metals, and wherein said hard phase consists essentially of at least two different kinds of metals selected from Group IVa, Va and VIa metals of the Periodic Table in combination with carbon, nitrogen and oxygen, which hard phase is represented by the molecular formula $(M_A, M'_B, M''_C)(C_uN_vO_w)_z$ wherein M represents Group IVa metals, M' represents Group Va metals and M'' represents Group VIa metals A, B, C and u, v, w represent the atomic ratio of the elements in the formula, and z represents the ratio of the total number of the metallic atoms to that of C,N,O atoms, with the relationship such that $A+B+C=1$, $u+v+w=1$, $A \geqq O$, $B \geqq O$, $A+B>O$, $C>O$, $u>O$, $z \geqq 0.6$, and $0.005<v+w \leqq 0.5$ and $0.005\ W<0.5$, which sintered hard metal of the above formula is produced by mixing two or more different kinds of Group IVa, Va, or VIa metal compounds selected from oxides, carbides and nitrogen containing compounds of said metals with WC and iron Group metals which make up a bonding phase, the whole of said mixture being pressed into a predetermined shape and sintered, said sintering being performed in a CO partial pressure atmosphere above 5 Torr during all or part of the time during which the sintering temperature is in excess of 600° C. and in a vacuum atmosphere below $10^{-1}$ Torr during all or part of the time at which a liquid phase appears.

6. The method for producing a sintered hard metal as defined in claim 5, further characterized in that sintering is effected under a vacuum atmosphere lower than $10^{-1}$ Torr when the heating temperature is highest.

7. The method for producing a sintered hard metal as defined in claim 5, further characterized in that a part of W in the WC phase is replaced by another element which does not change the crystal structure of the hexagonal system.

8. The method for producing a sintered hard metal as defined in claim 5, further characterized in that the B-1 type hard phase contains no oxygen before the sintering process.

9. A method according to claim 5, in which the hard phase contains at least two metals selected from the group consisting of Ti, Ta, Nb and W.

* * * * *